US009254508B2

(12) United States Patent
Tokuda et al.

(10) Patent No.: US 9,254,508 B2
(45) Date of Patent: Feb. 9, 2016

(54) POWDER AND GRANULAR MATERIAL SEPARATION PROCESSING DEVICE, POWDER AND GRANULAR MATERIAL SEPARATION PROCESSING METHOD, AND POWDER AND GRANULAR MATERIAL SEPARATION AND COLLECTION PROCESSING SYSTEM

(75) Inventors: Tomoaki Tokuda, Iwakuni (JP); Shuji Yamamoto, Iwakuni (JP)

(73) Assignee: KASHIWABARA CORPORATION, Iwakuni-shi (JP)

( * ) Notice: Subject to any disclaimer, the term of this patent is extended or adjusted under 35 U.S.C. 154(b) by 0 days.

(21) Appl. No.: 14/347,398

(22) PCT Filed: Sep. 11, 2012

(86) PCT No.: PCT/JP2012/073124

§ 371 (c)(1),
(2), (4) Date: Mar. 26, 2014

(87) PCT Pub. No.: WO2013/047177

PCT Pub. Date: Apr. 4, 2013

(65) Prior Publication Data

US 2014/0238908 A1 Aug. 28, 2014

(30) Foreign Application Priority Data

Sep. 29, 2011 (JP) ..... 2011-213978
Mar. 29, 2012 (JP) ..... 2012-001781 U

(51) Int. Cl.

| | |
|---|---|
| ***B07B 4/00*** | (2006.01) |
| ***B07B 7/00*** | (2006.01) |
| ***B07B 4/04*** | (2006.01) |
| ***B07B 4/02*** | (2006.01) |
| ***B07B 7/01*** | (2006.01) |
| ***B07B 7/04*** | (2006.01) |

(52) U.S. Cl.

CPC ... *B07B 4/04* (2013.01); *B07B 4/02* (2013.01); *B07B 7/01* (2013.01); *B07B 7/04* (2013.01)

(58) Field of Classification Search

CPC ..... B07B 4/02; B07B 4/04; B07B 7/01; G03G 9/0817; G03G 9/08174

USPC ..... 209/133, 138, 139.1, 142, 143, 643, 209/932, 146, 150

See application file for complete search history.

(56) References Cited

U.S. PATENT DOCUMENTS 422,943 A * 3/1890 Holt ..... B07B 4/025 209/139.2
5,735,403 A * 4/1998 Stiglianese ..... B07B 7/06 209/143

FOREIGN PATENT DOCUMENTS

| | | | |
|---|---|---|---|
| DE | 29 43 298 | A1 | 10/1979 |
| EP | 1 787 729 | A1 | 5/2007 |
| JP | S09-16960 | | 12/1934 |
| JP | S49-109272 | | 9/1974 |
| JP | S51-34079 | | 3/1976 |
| JP | S51-73775 | | 6/1976 |
| JP | S52-165153 | | 12/1977 |
| JP | S53-134285 | | 10/1978 |
| JP | 6-63454 | A | 3/1994 |
| JP | H06-63454 | | 3/1994 |
| JP | H08-25223 | | 1/1996 |
| JP | H09-193019 | | 7/1997 |
| JP | 2000-329469 | | 11/2000 |
| JP | 2001-212764 | A1 | 8/2001 |
| JP | 3090039 | U | 11/2002 |
| JP | 2004-9222 | A1 | 1/2004 |
| JP | 2004-283720 | A1 | 10/2004 |
| JP | 2007-275863 | A1 | 10/2007 |

OTHER PUBLICATIONS

International Search Report for International Application No. PCT/JP2012/073124 dated Dec. 18, 2012.

* cited by examiner

*Primary Examiner* — Prasad Gokhale
(74) *Attorney, Agent, or Firm* — Kratz, Quintos & Hanson, LLP

(57) ABSTRACT

To introduce a mixture to be processed, in which powder and granular material with relatively large specific gravity and hardness and accompanying lightweight foreign substances are mixed together, inside a system and separate the same by a dry method.

Disclosed is a powder and granular material separation processing device X that is connected to an external suction machine such as a dust collection device and an electric vacuum cleaner, introduces by suction a mixture to be processed into a separation processing container 1, and discharges lightweight foreign substances to the outside of a system while collecting powder and granular material inside the system. The separation processing container 1 has a suction introduction tube 2 that is attached and sealed as the upper part structure of a hopper tank 4 that collects and stores the powder and granular material and receives the mixture to be processed on the circumferential surface thereof, and a suction discharge tube 3 that is connected to an external suction machine on the upper surface thereof. In addition, the separation processing container 1 has a separation cone 11 with a funnel-shaped bottom surface and a cylindrical opening 13 that hangs in a protruding shape downward from the tip part of the separation cone 11 and of which the opening diameter thereof is reduced stepwise to have multiple steps. The suction discharge tube 3 has a multiple tube configuration at the tip part thereof in which each tube is given a small diameter corresponding to each opening diameter of the cylindrical opening 13 to be loosely inserted and face the tip part of an opening.

21 Claims, 11 Drawing Sheets

P PART DETAILS

| | LESS THAN 0.1 mm | 0.1 mm OR LARGER/LESS THAN 0.2 mm | 0.2 mm OR LARGER/LESS THAN 0.5 mm | 0.5 mm OR LARGER/LESS THAN 1.0 mm | 1.0 mm OR LARGER/LESS THAN 1.4 mm | 1.4 mm OR LARGER/LESS THAN 2.0 mm |
|---|---|---|---|---|---|---|
| SEPARATED RECYCLABLE GRANULAR MATERIAL | 19.2 | 27.4 | 42.9 | 10.2 | 0.3 | 0 |

UNIT: WEIGHT%

SEPARATED RECYCLABLE GRANULAR MATERIAL

| | LESS THAN 0.1 mm | 0.1 mm OR LARGER/LESS THAN 0.2 mm | 0.2 mm OR LARGER/LESS THAN 0.5 mm | 0.5 mm OR LARGER/LESS THAN 1.0 mm | 1.0 mm OR LARGER/LESS THAN 1.4 mm | 1.4 mm OR LARGER/LESS THAN 2.0 mm |
|---|---|---|---|---|---|---|
| SEPARATED INDUSTRIAL WASTE POWDER MATERIAL | 58.9 | 26.0 | 13.3 | 1.7 | 0.1 | 0 |

UNIT: WEIGHT%

POWDER AND GRANULAR MATERIAL SEPARATION PROCESSING DEVICE, POWDER AND GRANULAR MATERIAL SEPARATION PROCESSING METHOD, AND POWDER AND GRANULAR MATERIAL SEPARATION AND COLLECTION PROCESSING SYSTEM

TECHNICAL FIELD

The present invention relates to a powder and granular material separation processing device, a powder and granular material separation processing method, and a powder and granular material separation and collection processing system that introduce by suction a mixture to be processed, in which powder and granular material with relatively large specific gravity and hardness and initially formed into a grit or shot shape with a grain diameter of several mm or less and accompanying lightweight foreign substances are mixed together, inside a system and separate the powder and granular material from the lightweight foreign substances by a dry method.

More specifically, the present invention according to the first basic application (JP 2011-213978 A) relates to the powder and granular material separation processing device and the powder and granular material separation processing method that are used to introduce by suction the mixture to be processed into a separation processing container connected to an external suction machine such as a dust collection device and an electric vacuum cleaner, separate the same using an airflow and a specific gravity difference with the control of a flow inside the container, and discharge the lightweight foreign substances to the outside of the system toward the external suction machine while collecting the powder and granular material inside the system.

In addition, the present invention according to the second basic application (JP 2012-1781 Y) relates to the powder and granular material separation and collection processing system that includes the powder and granular material separation processing device described above as a constituent device of a device system, houses upstream and downstream cooperation machines (devices) vacuum-connected to the powder and granular material separation processing device inside a single frame serving as a platform, and arranges the same in line in the order of processes to perform the processes systematically. Note that the terms of the device system and the system are interchangeably used.

Typical examples of the mixture to be processed used in the present invention can include one in which an abrasive (powder and granular material) subjected to a blast process by a dry air blast device and accompanying lightweight foreign substances are mixed together. The specific gravity of each of the abrasive (powder and granular material) and the lightweight foreign substances is one digit, and a difference in the specific gravity between them is relatively small.

Here, the abrasive is roughly divided into a metal system and a non-metal system. A metal abrasive is powder and granular material made of cast iron or cast steel, so-called a steel grit or a steel shot. A non-metal abrasive is grit or shot powder and granular material made of a natural mineral or a rock forming mineral (see, if necessary, the paragraph of an abrasive in the regulations of a blast processing method for conditioning JISZ0310 base metal).

Note that the term grit refers to an angulated grain, and the term shot refers to a less-angulated grain.

BACKGROUND ART

Conventionally, in order to collect waste plastics resulting from containers, electric appliance wastes, information equipment wastes, or the like as regenerative resins, a known cyclone type airflow applied separation device uses, as a mixture to be processed, crushed plastic granular material containing many lightweight foreign substances such as paper slips that is crushed to have a grain diameter of 10 mm or less and subjected to dry washing mainly for separating a degraded front surface layer (see, for example, Patent Literature 1).

Note that the cyclone type refers to a separation system that turns dust-containing gas (same as gas containing a mixture to be processed) and separates by centrifugalization powder and granular material or the like from the gas to be collected or classified.

Here, attention is given to the point that a centrifugal falling airflow containing granular material is collected as a rapidly-accelerated vortex flow at the lower space of the tip opening of an airflow discharge tube inside a cylinder by a partition plate with an opening at the center thereof, which promotes the function of separating the lightweight foreign substances from a solid content and increases floating separation efficiency with an upstream flow.

However, since the crushed waste plastics are required (allowed) to have a grain diameter of 10 mm or less, it is presumed that the distribution of the grain sizes is complex and bulk specific gravity is different. In short, it seems that the granular solid content resulting from the crushing and the lightweight foreign substances or the like with small bulk specific gravity such as a separated front surface abrasive layer (crushed fine powder), paper slips, and tape slips are floated and selected with the application of a cyclone type airflow.

On the other hand, there have been known some proposals that separate and collect used blast material (equivalent to the abrasive of the present invention) (see, for example, Patent Literatures 2, 3, 4, and 5). These conventional examples generally relate to filter separation, screening selection, wind selection, or floating selection.

CITATION LIST

Patent Literature

Patent Literature 1; JP 2004-283720 A
Patent Literature JP 2004-9222 A.
Patent Literature JP 2001-212764 A
Patent Literature JP 9-193019 A
Patent Literature 5 JP 8-25223 A.

In recent years, since "silica sand" among natural minerals is not used as a non-metal abrasive for blasting from the viewpoint of preventing silicosis, the alternative use of almandine garnet [$Fe_3Al_2(SiO_4)_3$] is on the increase. As representative properties, almandine garnet has specific gravity of 4.1 and Mohs hardness of 7.6 to 8.3. Note that garnet is now almost dependent on imports.

For example, as the properties of garnet powder and granular material (mixture to be processed) subjected to a blast process, the garnet powder and granular material has a grain size distribution (grain diameter) of generally 3 mm or less. Further, assuming that the (depleted) garnet powder and granular material reusable as an abrasive has a grain diameter of 0.2 mm or larger, powder material having a grain diameter of less than 0.2 mm, more specifically less than 0.1 mm is disposable powder material (hereinafter referred to as industrial waste powder material) made of lightweight foreign substances such as a (polished and cleaned) coating film and rust separated from a front surface and abrasive powder resulting from abrasion. Currently, the abrasive of this type is discarded after being subjected to a blast process.

Under such circumstances, it is strongly demanded that a mixture to be processed in which powder and granular material with relatively large specific gravity and hardness and initially formed into a grit or shot shape with a grain diameter of several mm or less and accompanying lightweight foreign substances are mixed together, particularly powder and granular material (containing accompanying lightweight foreign substances) subjected to a blast process by a dry air blast device is efficiently separated to collect reusable powder and granular material (hereinafter referred to as recyclable granular material) to promote material recycle. The mixture to be processed of this type has a relatively small specific gravity difference, and thus there is a problem in separating the mixture.

However, even with the application of the conventional technologies described above, those with small specific gravity are hardly separated from each other, which gives rise to the problem that the powder and granular material (abrasive) with a reusable grain diameter (for example, about 0.2 to 0.5 mm) is transferred to a waste side or industrial waste powder material (with a grain diameter of, for example, 0.2 mm or less) abundantly remains on a collection side. In addition, it is presumed that the conventional technologies are based on a batch process, and thus there is a problem in the transfer between a blast operation site and a separation process site.

As a matter of course, there has been raised a problem about separating powder and granular material (specifically a mixture to be processed) subjected to a blast process at a blast operation site and immediately reusing the same. In addition, in response to a demand for increasing yields, there has been raised a problem about improving separation accuracy.

The present inventors have promoted the research and development of a separation processing technology capable of separating the powder and granular material of this type (a mixture to be processed containing accompanying lightweight foreign substances) into recyclable granular material reusable as an abrasive and industrial waste powder material and efficiently collecting the recyclable granular material.

Particularly, the present inventors have repeatedly made an attempt to arrange and connect a powder and granular material separation processing device upstream of an external suction machine such as an existing dust collection device and an electric vacuum cleaner, collect recyclable granular material inside a system with the powder and granular material separation processing device, and discharge industrial waste powder material to the outside of the system to reduce the load of the external suction machine.

The present invention (the powder and granular material separation processing device and the powder and granular material separation processing method) according to the first basic application is one of the results, and separates, based on a new device configuration, a mixture to be processed received in a separation processing container by a method in which recyclable granular material is fallen and collected, while industrial waste powder material is discharged by suction through multiple stages using an airflow and a specific gravity difference with the control of a flow inside the container.

In addition, in promoting the continuous research and development, one of the present inventors [Tomoaki Tokuda] has configured a device system unit including the powder and granular material separation processing device according to the first basic application, machines (devices) upstream and downstream of the powder and granular material separation processing device, and attached machines, and has conceived a compact separation and collection processing system capable of receiving a mixture to be processed (introducing the same into a system) and systematically performing a series of processes from the separation to collection of recyclable granular material and industrial waste powder material containing lightweight foreign substances inside the system.

The present invention (the powder and granular material separation and collection processing system) according to the second basic application is one of the results, and has developed the portable and mobile powder and granular material separation and collection processing system in which the device system unit including the present invention device (the powder and granular material separation processing device) according to the first basic application is mounted on a single platform and made compact.

SUMMARY OF INVENTION

Technical Problem

A problem to be solved by the present invention according to the first basic application is to separate a mixture to be processed, in which powder and granular material with relatively large specific gravity and hardness and initially formed into a grit or shot shape with a grain diameter of several mm or less and accompanying lightweight foreign substances are mixed together, and collect recyclable grain material inside a system. Here, it is necessary to consider the point that a difference in the specific gravity between the powder and granular material and the lightweight foreign substances is relatively small.

Particularly, the technical solution problem is to separate the powder and granular material made of an abrasive subjected to a blast process by a dry air blast device (containing the accompanying lightweight foreign substances) and discharge the lightweight foreign substances and industrial waste powder material with a small grain diameter to the outside of the system, while collecting the recyclable granular material inside the system. Thus, the objective effect of promoting material recycle is attained. In addition, the objective effect of reducing the load of an external suction machine connected on a downstream side is included.

The present invention according to the first basic application has been made in view of the circumstances described above and provides a powder and granular material separation processing device and a powder and granular material separation processing method that solve the problems described above, introduce by suction a mixture to be processed into a separation processing container connected to an external suction machine such as a dust collection device and an electric vacuum cleaner, separates the same using an airflow and a specific gravity difference by a dry method with the control of a flow inside the container, and discharge lightweight foreign substances containing industrial waste power material to the outside of a system toward the external suction machine while collecting powder and granular material (recyclable granular material) inside the system.

On the other hand, a problem to be solved by the present invention according to the second basic application is to make the powder and granular material separation processing device according to the first basic application and upstream and downstream cooperation machines (devices) vacuum-connected to the device into a device system unit to functionally configure a processing system and perform a series of systematic processes in which recyclable granular material is separated from industrial waste powder material containing lightweight foreign substances inside one device system and separation-collected.

In addition, the problem includes mounting (housing) the device system unit inside a single frame (portable device frame that will be described later) serving as a platform and arranging the same in line in the order of processes to functionally configure the processing system and provide transportable and on-site installable mobility.

The present invention according to the second basic application has been made in view of the circumstances described above and provides a powder and granular material separation and collection processing system that solves the problems described above, installs a device system unit so as to be accessible to an operation site (for example, a dry air blast device), introduces by suction a mixture to be processed (for example, an abrasive after being subjected to blasting) resulting from an operation, and performs a series of systematic processes from separation to collection.

Solution to Problem

To solve the above problems, the present invention according to the first basic application provides a powder and granular material separation processing device that introduces a mixture to be processed, in which powder and granular material with relatively large specific gravity and hardness and initially formed into a grit or shot shape with a grain diameter of several mm or less and accompanying lightweight foreign substances are mixed together, into a system and separates the powder and granular material from the lightweight foreign substances by a dry method, wherein the powder and granular material separation processing device introduces by suction the mixture to be processed into a separation processing container connected to an external suction machine such as a dust collection device and an electric vacuum cleaner, separates the same using an airflow and a specific gravity difference with a control of a flow inside the container, and discharges the lightweight foreign substances to the external suction machine while collecting the powder and granular material inside the system, the powder and granular material separation processing device includes a separation processing container having a hopper tank that collects and stores the powder and granular material, a suction introduction tube that is attached and sealed as an upper part structure of the hopper tank and receives the mixture to be processed on a circumferential surface thereof, and a suction discharge tube that is connected to the external suction machine on an upper surface thereof, the separation processing container has a separation cone with a funnel-shaped bottom surface and a cylindrical opening that hangs in a protruding shape downward from a tip part of the separation cone and of which an opening diameter thereof is reduced stepwise to have multiple steps, the suction discharge tube has a multiple tube configuration at a tip part thereof in which each axial core corresponds to a rotational axis (cone axis) of the separation cone and each tube is given a small diameter corresponding to each opening diameter of the cylindrical opening to be loosely inserted and face a tip part of an opening, and the mixture to be processed introduced by suction into the separation processing container is fallen and guided to the cylindrical opening, while the lightweight foreign substances are sucked by the suction discharge tube through multiple stages and discharged to an side of the system and the rest powder and granular material is freely fallen and collected inside the system.

Further, the present invention provides a powder and granular material separation processing method for separating powder and granular material from lightweight foreign substances with a control of a flow in such a manner that falling and guiding of a mixture to be processed by a separation cone and suction discharge of the lightweight foreign substances by a suction discharge tube are cooperated with each other inside a separation processing container in the powder and granular material separation processing device, wherein the mixture to be processed received by suction introduction is received on an inner front surface of the separation cone to be prevented from temporarily turning and falling while being separated by weight using an airflow generated inside the separation processing container, and the lightweight foreign substances are sucked by the suction discharge tube through multiple stages and discharged to an outside of a system and the rest powder and granular material is fallen and collected when the mixture to be processed is fallen and guided to a cylindrical opening of the separation cone in a cascade state based on a subsequent free fall thereof with bouncing.

To solve the above problems, the present invention according to the second basic application provides a powder and granular material separation and collection processing system that includes a powder and granular material separation processing device (same as the present invention device according to the first basic application) that introduces by suction a mixture to be processed, in which powder and granular material with relatively large specific gravity and hardness and initially formed into a grit or shot shape with a grain diameter of several mm or less and accompanying lightweight foreign substances are mixed together, and separates the powder and granular material from the lightweight foreign substances by a dry method, houses upstream and downstream cooperation machines or cooperation devices vacuum-connected to the powder and granular material separation processing device inside a single frame serving as a platform, and arranges the same in line in an order of processes to perform the processes systematically, the powder and granular material separation and collection processing system including:

a hopper tank device that is responsible for a first process to receive the mixture to be processed from an outside of a system and temporarily store the same;

the powder and granular material separation processing device that is responsible for a second process to separate recyclable granular material with a relatively large grain diameter from industrial waste powder material and the lightweight foreign substances with a relatively small grain diameter by a dry method, the recyclable granular material, the industrial waste powder material, and the lightweight foreign substances being transferred and introduced from the hopper tank device and constituting the mixture to be processed;

a flexible bag container that is provided under the powder and granular material separation processing device so as to be detachable and replaceable and in which the separated recyclable granular material is fallen and collected to be stored;

a cyclone dust collection device that is introduced from the powder and granular material separation processing device via a tube and responsible for a third process to separate the separated industrial waste powder material and the lightweight foreign substances from dust;

a flexible bag container that is provided under the cyclone dust collection device so as to be detachable and replaceable and in which the separated industrial waste powder material and the lightweight foreign substances are fallen and collected to be stored;

a suction device such as an electric vacuum cleaner that is connected to the cyclone dust collection device via a tube and responsible for a fourth process to introduce by suction the separated dust and finally catch the same while serving as a drive source for a vacuum path of a device system; and a portable device frame that is used to arrange a group of the devices including the flexible bag containers in line in the order of the processes, house the same inside a single frame or casing, construct a device system unit having a processing system of one line or a plurality of parallel lines, and is used as a platform capable of being transferred and provided on site, wherein the device system unit is operated to execute the first to fourth processes systematically inside the system.

Advantageous Effects of Invention

With the present invention device according to the first basic application, it is possible to separate a mixture to be processed in which powder and granular material with relatively large specific gravity and hardness and initially formed into a grit or shot shape with a grain diameter of several mm or less and accompanying foreign substances are mixed together, collect powder and granular material (recyclable granular material) inside a system, and discharge industrial waste powder material containing lightweight foreign substances to the outside of the system.

Particularly, by efficiently separating the powder and granular material made of an abrasive subjected to a blast process by a dry air blast device (containing the accompanying lightweight foreign substances) and collecting the recyclable granular material inside the system, it is possible to contribute to the promotion of material recycle. In addition, by discharging the industrial waste powder material (containing the lightweight foreign substances and the abrasive made into powder by depletion; the same applies hereafter), it is possible to reduce the load of an external suction machine connected on a downstream side.

Further, with the present invention method according to the first basic application, it is possible to collect powder and granular material (recyclable granular material) inside a system and discharge lightweight foreign substances or the like (industrial waste powder material) to the outside of the system through multiple stages with the control of the flow of a mixture to be processed in such a manner that cascade falling and guiding toward the cylindrical opening of a separation cone and suction discharge are cooperated with each other. As a matter of course, it is possible to appropriately adjust a suction force according to the properties of the mixture to be processed.

Accordingly, the present invention method is applied to, besides an abrasive, various mixtures to be processed including powder and granular material resulting from crushed waste plastics, powder and granular material such as grains, and accompanying lightweight foreign substances, and is advantageous in that it is capable of flexibly responding to each separation condition and has high versatility.

Moreover, with the present invention system according to the second basic application, it is possible to perform intra-system processing with a device system unit that introduces a mixture to be processed, in which powder and granular material with relatively large specific gravity and hardness and initially formed into a grit or shot shape with a grain diameter of several mm or less and accompanying lightweight foreign substances are mixed together, inside a system and systematically performs a series of processes from the separation of recyclable granular material and industrial waste powder material (containing lightweight foreign substances) to the separated collection of the recyclable granular material and the industrial waste powder material (containing the lightweight foreign substances).

Particularly, since the device system unit is mounted on a portable device frame and capable of being transported and installed on site, it is installed so as to be accessible to an operation site (for example, a dry air blast device), introduces by suction a mixture to be processed (for example, an abrasive after being subjected to blasting) resulting from an operation, efficiently separates recyclable granular material from industrial waste powder material in the mixture to be processed, and collects the recyclable granular material inside a system, thereby making it possible to contribute to the promotion of material recycle. In addition, it is possible to separate and collect the industrial waste powder material without discharging the same to the outside of the system.

DESCRIPTION OF EMBODIMENTS

Figure 1:
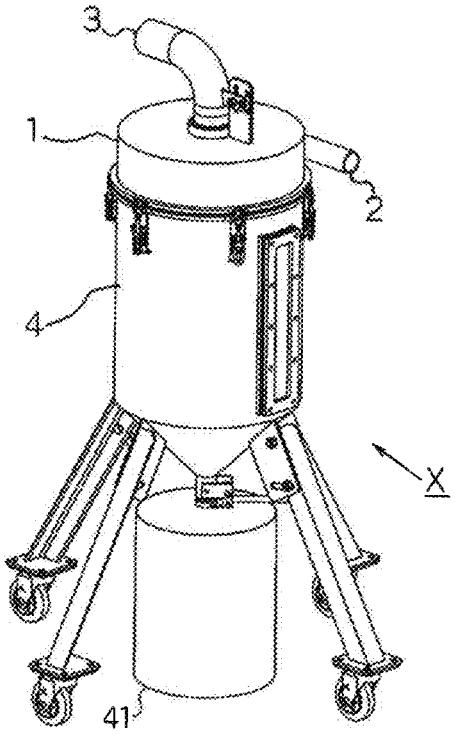
FIG. 1 a perspective explanatory diagram of an embodiment device.

A mode for carrying out the present invention is that a separation cone has radially-formed rectification ribs made of a plurality of elastic bodies on the inner front surface thereof in a powder and granular material separation processing device with the configuration described above according to the first basic application.

Here, a mixture to be processed is optimally one subjected to a blast process by a dry air blast device. It does not matter whether the mixture to be processed is a metal abrasive or a non-metal abrasive.

In addition, in a powder and granular material separation processing method with the configuration described above according to the first basic application, a separation cone receives a mixture to be processed with radially-formed rectification ribs made of a plurality of elastic bodies on the inner front surface thereof to increase the falling and guiding of the mixture to be processed.

In a powder and granular material separation and collection processing system with the configuration described above according to the second basic application, a powder and granular material separation processing device may use the powder and granular material separation processing device according to the first basic application.

The characteristic configuration is that the powder and granular material separation processing device includes a separation processing container having a hopper tank portion that collects and stores powder and granular material, a suction introduction tube that is attached and sealed as the upper part structure of the hopper tank portion and receives a mixture to be processed on the circumferential surface thereof, and a suction discharge tube that is connected to a suction machine on the upper surface thereof. In addition, the separation processing container has a separation cone with a funnel-shaped bottom surface and a cylindrical opening that hangs in a protruding shape downward from the tip part of the separation cone and of which the opening diameter thereof is reduced stepwise to have multiple steps. The suction discharge tube has a multiple tube configuration at the tip part thereof in which each axial core corresponds to the rotational axis (cone axis) of the separation cone and each tube is given a small diameter corresponding to each opening diameter of the cylindrical opening to be loosely inserted and face the tip part of the opening. Moreover, the mixture to be processed introduced by suction into the separation processing container is fallen and guided to the cylindrical opening, while industrial waste powder material is sucked by the suction discharge tube through multiple stages and discharged to a downstream cyclone dust collection device and the rest powder and granular material is fallen and collected into a flexible bag container.

Here, the mixture to be processed is optimally one subjected to a blast process by a dry air blast device (it does not matter whether the mixture to be processed is a metal abrasive or a non-metal abrasive), and is supplied under pressure to a hopper tank device after being directly or temporarily stored.

First Embodiment

A description will be given, with reference to the accompanying drawings, of an embodiment of the powder and granular material separation processing device (hereinafter referred to as the embodiment device X) of the present invention according to the first basic application.

FIG. 1 illustrates a perspective explanatory diagram of the embodiment device X.

As illustrated in the figure, the embodiment device X is connected to an external suction machine (omitted in the figure) such as a dust collection device and an electric vacuum cleaner, introduces by suction a mixture to be processed, in which powder and granular material made of a system abrasive subjected to a blast process by a dry air blast device (omitted in the figure) and accompanying light weight foreign substances are mixed together, into a separation processing container 1, separates the same with the application of an air flow and a specific gravity difference by a dry method, and discharges the lightweight foreign substances (containing industrial waste powder material) to the outside of a system toward the external suction machine while collecting the powder and granular material inside the system.

The separation processing container 1 has a hopper tank 4 that collects and stores the powder and granular material, a suction introduction tube 2 that is attached and sealed as the upper part structure of the hopper tank 4 and receives the mixture to be processed on the circumferential surface thereof, and a suction discharge tube 3 that is connected to the external suction machine on the upper surface thereof. Note that a detachable collection container 41 is disposed under the hopper tank 4.

Figure 2:
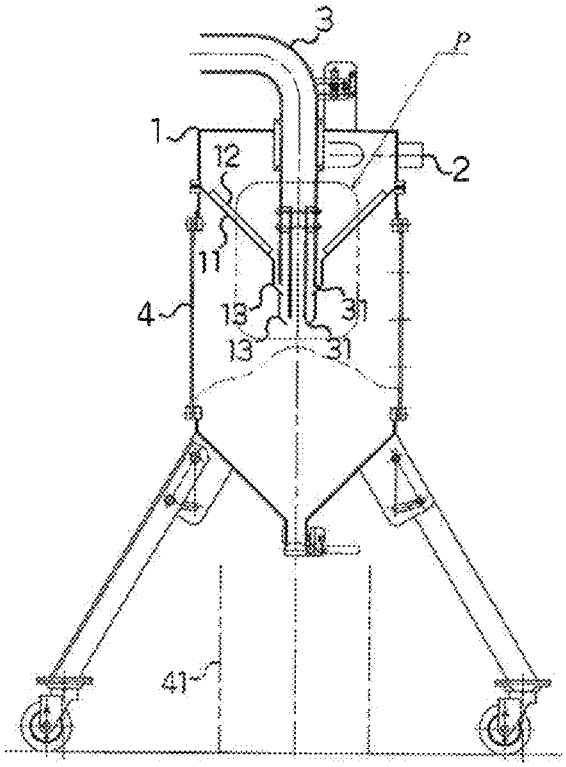
FIG. 2 is an explanatory diagram of the embodiment device in a cross-sectional view.
Figure 3:
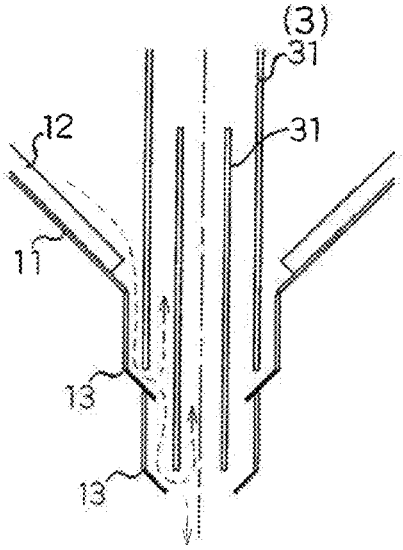
FIG. 3 is a detailed explanatory diagram of a P part in FIG. 2.

FIG. 2 illustrates an explanatory diagram of the embodiment device X in a cross-sectional view, and FIG. 3 illustrates a detailed explanatory diagram of a P part in FIG. 2.

As illustrated in the figures, the inner structure of the separation processing container 1 has a separation cone 11 with a funnel-shaped bottom surface and a cylindrical opening 13 that hangs in a protruding shape downward from the tip part of the separation cone 11 and of which the opening diameter thereof is reduced stepwise to have multiple steps.

In addition, the separation cone 11 has radially-formed rectification ribs 12 made of a plurality of elastic bodies on the inner front surface thereof.

The suction discharge tube 3 has a multiple tube configuration (31;31) at the tip part thereof in which each axial core corresponds to the rotational axis (cone axis) of the separation cone 11 and each tube is given a small diameter corresponding to each opening diameter of the cylindrical opening 13 to be loosely inserted and face the tip part of the opening.

Figure 4:
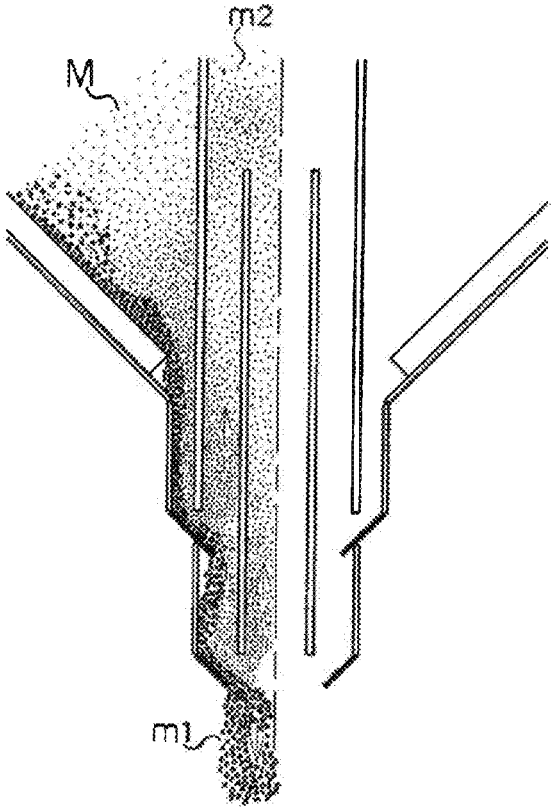
FIG. 4 is a schematic explanatory diagram illustrating the flow control of a mixture to be processed in a separation processing container.

FIG. 4 illustrates a schematic explanatory diagram in a cross-sectional view for schematically illustrating the flow control of the mixture to be processed in the separation processing container.

As illustrated in each of FIG. 3 and FIG. 4, a mixture M to be processed introduced by suction into the separation processing container 1 is fallen and guided to the cylindrical opening 13, and lightweight foreign substances m2 (containing industrial waste powder material) are sucked by the suction discharge tube 3 (31;31) through multiple stages and discharged to the outside of the system while the rest powder and granular material m1 (recyclable granular material) is freely fallen and collected inside the system.

More specifically, the mixture M to be processed is received on the inner front surface of the separation cone 11 to be prevented from temporarily turning and falling while being separated by weight using the airflow generated inside the separation processing container and is then fallen and guided to the cylindrical opening 13 in a cascade state based on subsequent free fall with bouncing. Meanwhile, the lightweight foreign substances m2 (containing the industrial waste powder material) are sucked by the suction discharge tube 3 (31;31) through the multiple stages and discharged to the outside of the system, while the rest powder and granular material m1 (the recyclable granular material) is fallen and collected.

Here, the separation cone 11 receives the mixture M to be processed (m1;m2) with the radially-formed rectification ribs 12 made of a plurality of elastic bodies on the inner front surface thereof to prevent the mixture M to be processed flowing in a turning direction and increase the falling and guiding thereof.

Hereinafter, a description will be given of the function and effect of the embodiment device X based on an experimental fact.

Figure 5A:
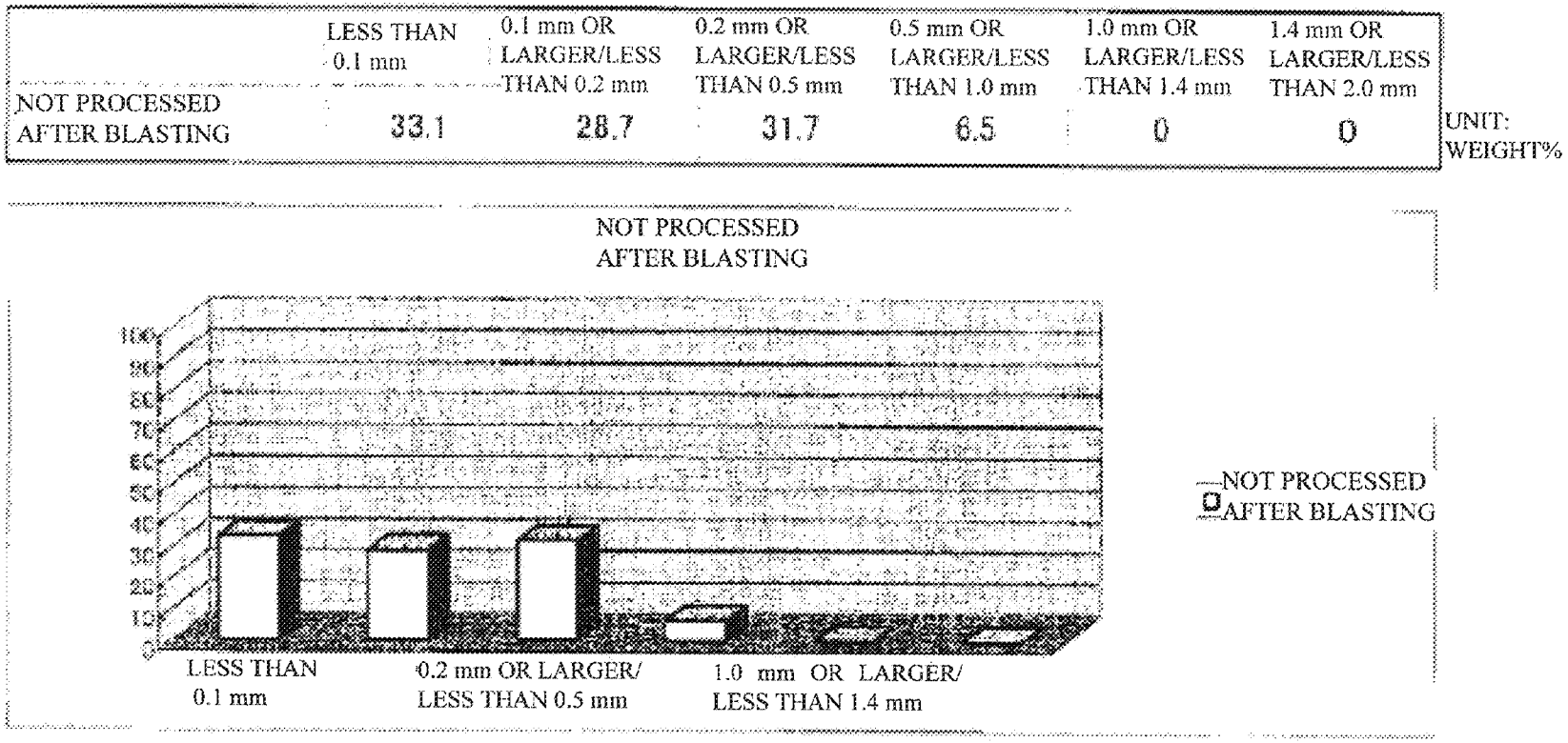
FIGS. 5(*a*) to 5(*c*) are the respective results of a screening test and the data plots thereof related to a grain size distribution indicating an experimental fact on the performance (function and effect) of the embodiment device, wherein FIG. 5(*a*) illustrates a mixture to be processed (sample) not processed after blasting, FIG. 5(*b*) illustrates separated recyclable granular material, and FIG. 5(*c*) illustrates separated industrial waste powder material.
Figure 5B:
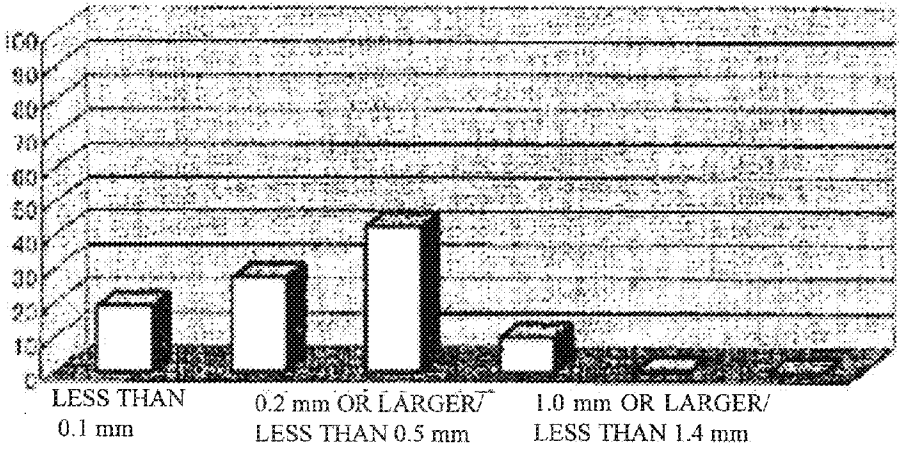
Figure 5C:
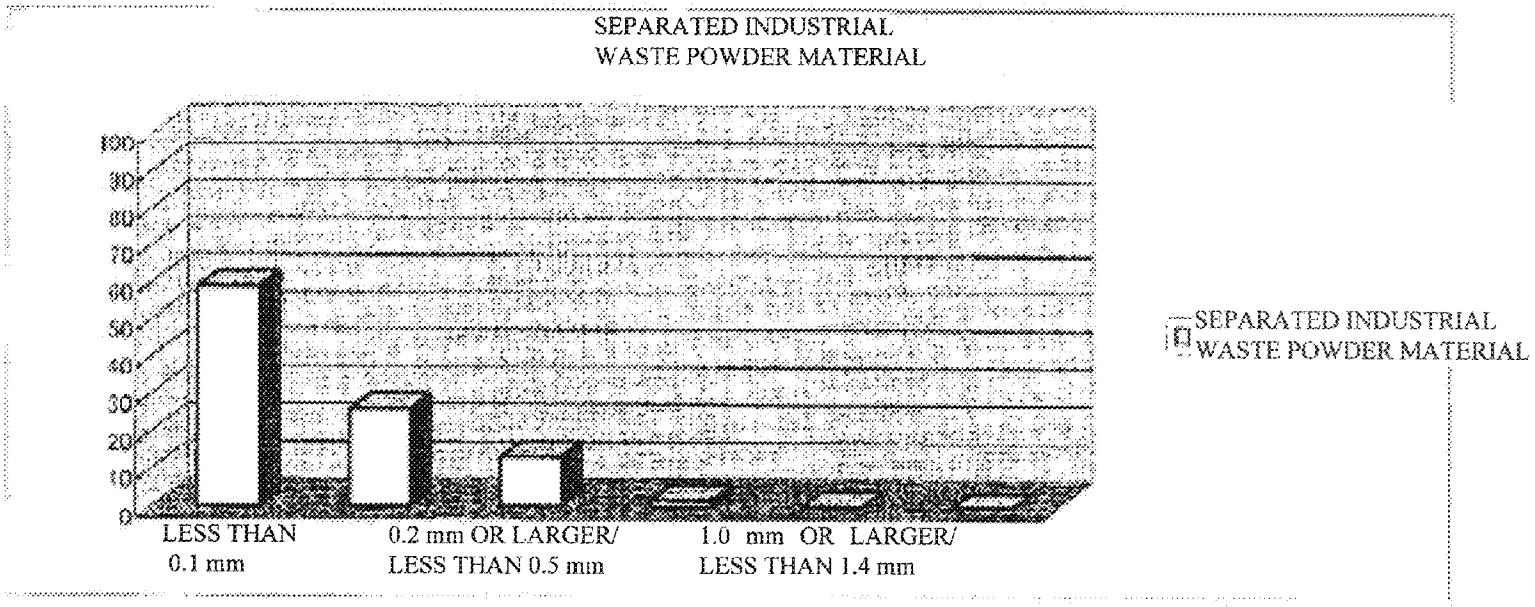

A sample is a garnet abrasive (mixture to be processed) not processed after blasting, and FIG. 5(*a*) illustrates a result of a screening test (weighing) indicating the distribution of the grain sizes (grain diameters) and the plot of the data.

As is clear from the figure (screening test), powder and granular material with a grain size of less than 0.2 mm accounts for 61.8 weight percent relative to the total weight of the mixture to be processed.

FIG. 5(*b*) illustrates a result of the screening test (weighing) indicating the distribution of the grain sizes (grain diameters) of reusable powder and granular material (same as recyclable granular material expressed in the figure) collected inside the system after the separation process and the plot of the data.

As is clear from the figure (screening test) the powder and granular material with a grain size of less than 0.2 mm accounts for 46.6 weight percent relative to the total weight of the mixture to be processed.

FIG. 5(*c*) illustrates a result of a screening test (weighing) indicating the distribution of the grain sizes (grain diameters) of waste powder material (same as industrial waste powder material expressed in the figure) discharged to the outside of the system after the separation process and the plot of the data.

As is clear from the figure (screening test), the powder and granular material with a grain size of less than 0.2 mm accounts for 84.9 weight percent relative to the total weight of the mixture to be processed.

Note that the ratio of the recyclable granular material collected inside the system after the separation process to the waste powder material discharged to the outside of the system was 65 to 35.

(Examination and Effect)

First, in the mixture to be processed not processed after blasting, the ratio of the recyclable granular material (with a grain diameter of 0.2 mm or larger) to the industrial waste powder material (with a grain diameter of less than 0.2 mm) is about 4 to 6 (see FIG. 5(*a*)).

Then, the mixture to be processed (not processed after blasting) is separated and collected inside, the system by 65 weight percent relative to its total amount (data is omitted in the figure).

Since the powder and granular material with a grain diameter of less than 0.2 mm accounts for 46.6 weight percent relative to the collected mixture to be processed (see FIG. 5(*b*)), it can be said that the rest mixture to be processed by 53.4 weight percent (i.e., about 30 percent of the total mixture to be processed) is powder and granular material capable of being effectively reused without any difficulty.

Actually, virgin material (abrasive) by 35 weight percent equivalent to the weight loss is added to the 65 weight percent of the recyclable granular material collected inside the system for reuse.

There may be a concern that the grinding performance could be slightly degraded in a blasting operation in the reuse since the recyclable granular material is mixed with the powder and granular material with a grain diameter of less than 0.2 mm.

However, since the fine grains are also carried by compression air and collide with a grinding front surface, they have no great impact on the grinding performance except that dust slightly increases.

In any case, this material recycle greatly contributes to a cost reduction than ever before in that about 60 percent of the mixture to be processed subjected to the blast process using the virgin material is reused.

Of course, it may also be possible to consider that the reused abrasive after blasting is separated again as a mixture to be processed.

As a matter of course, the rate of the industrial waste powder material increases with the number of reprocessed times, and the rate of collecting the recyclable granular material inside the system reduces. However, since the rate of the virgin material (abrasive) to be added increases, there is no concern that the grinding performance could be greatly degraded. In consideration of cost effectiveness, the number of the reprocessed times is practically limited to several times.

Meanwhile, the mixture to be processed (not processed after blasting) is separated and discharged to the outside of the system by 35 weight percent relative to its total amount (data is omitted in the figures).

About 60 percent of the discharged mixture to be processed is powder material with a grain diameter of less than 0.1 mm, and a little more than 20 percent thereof is powder material with a grain diameter of 0.1 mm or larger and less than 0.2 mm. On the whole, a little more than 80 percent (i.e., about 30 percent of the total mixture to be processed) is industrial waste powder material (see FIG. 5(*c*)).

Accordingly, the little more than 80 percent of the mixture to be processed, which is discharged to the outside of the system, is industrial waste powder material, and a downstream dust collection device that receives the mixture to be processed can perform dust collection processing without applying an unreasonable load.

Note that the rest 20 percent of the mixture to be processed is recyclable granular material (with a grain diameter of 0.2 mm or larger) mixed in the waste side (industrial waste powder material) and is forced to be discarded, but it is now an allowable limit in separation accuracy according to the method of the present invention.

Figure 6:
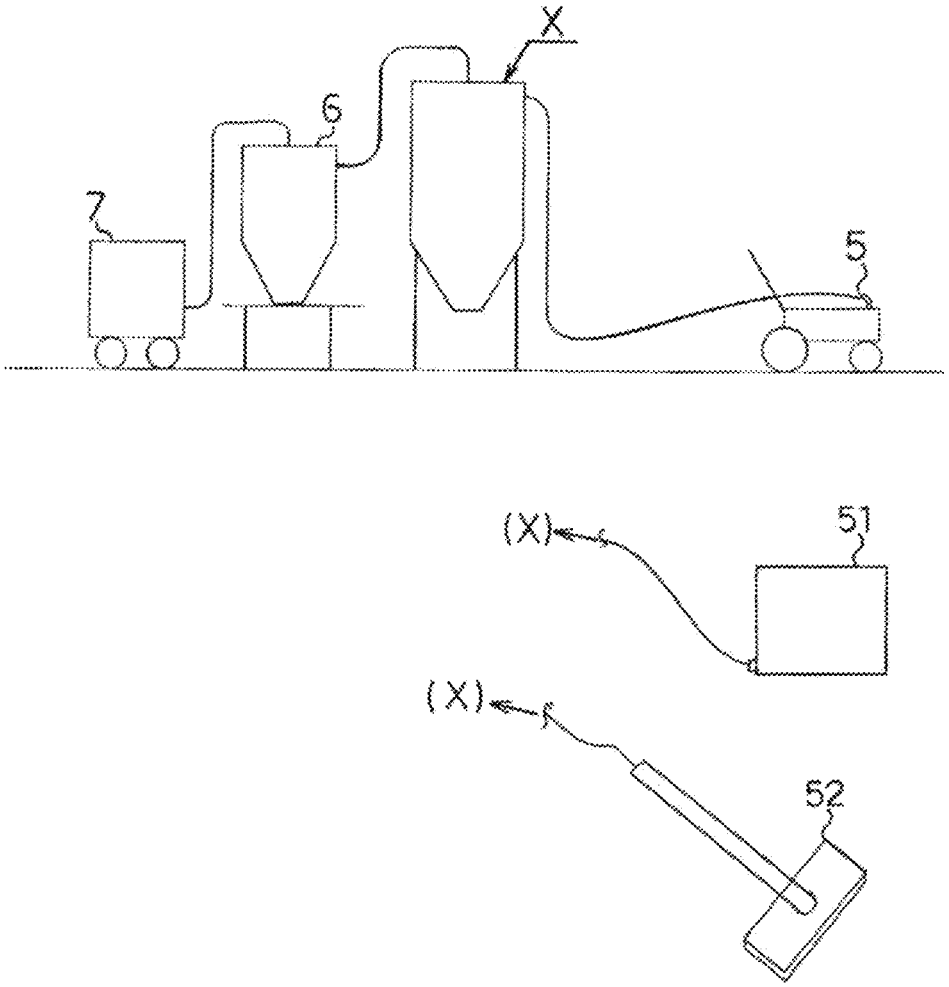
FIG. 6 is a configuration outline explanatory diagram illustrating a connection example in a case in which a device system is configured by the embodiment device, a blast device (upstream), and an external suction machine (downstream).

FIG. 6 is a configuration outline explanatory diagram illustrating a connection example in a case in which a processing system is configured by the embodiment device X, a blast device (upstream), and external suction machines (downstream).

As is clear from FIG. 6, a dry air blast device 5 is connected upstream of the embodiment device X, and a dust collection device 6 is connected downstream of the embodiment device X, and an electric vacuum cleaner 7 is connected to the dust collection device 6.

Here, there may be a case in which a floor sweeper 51 or a suction port (hose attachment) 52 is connected instead of the dry air blast device 5. A duct system (including the inside of the container) ranging from suction introduction to suction discharge is a suction path that uses the vacuum function of the electric vacuum cleaner 7 as a drive source.

Since the respective machines related to the blast operation are arranged on site and connected in cooperation with each other as described above, workability is improved and a cost reduction is made possible by material recycle.

Second Embodiment

A description will be given, with reference to the accompanying drawings, of the powder and granular material separation and collection processing system (hereinafter referred to as an embodiment system Z) as an embodiment of the present invention according to the second basic application.

Figure 7:
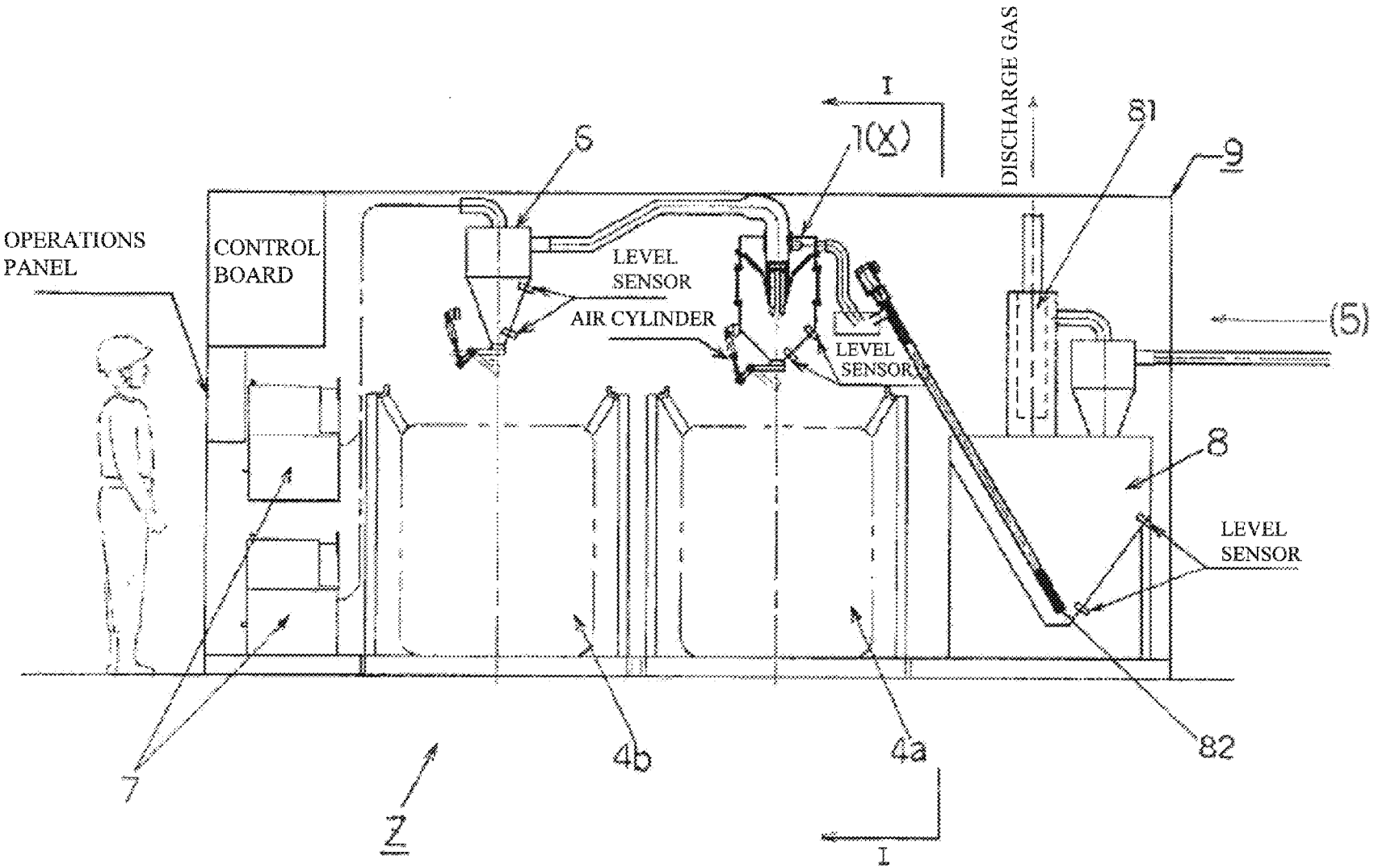
FIG. 7 is a configuration outline explanatory diagram of an embodiment system in a front view.
Figure 8:
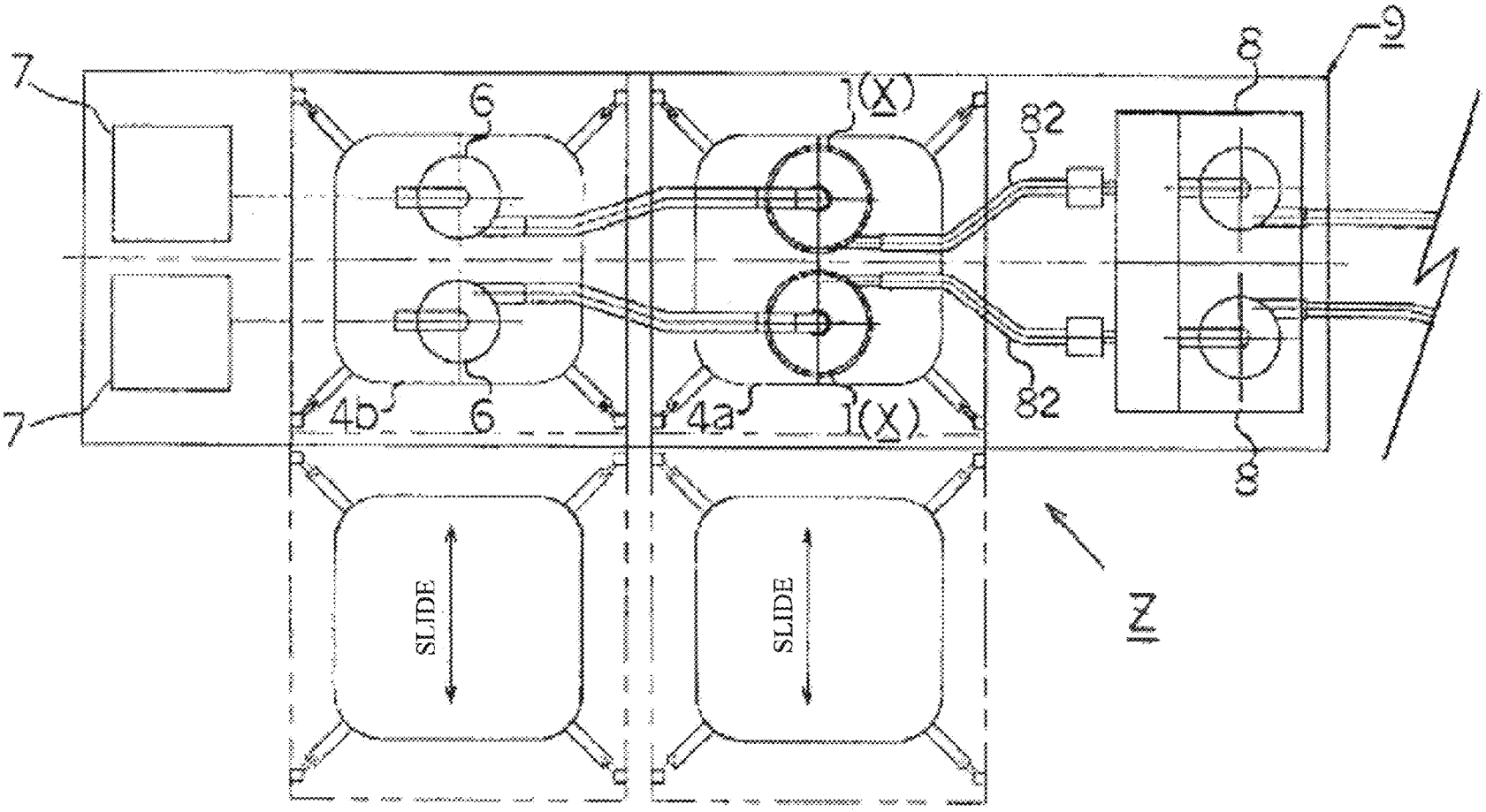
FIG. 8 is a configuration outline explanatory diagram of the embodiment system in a plan view.
Figure 9:
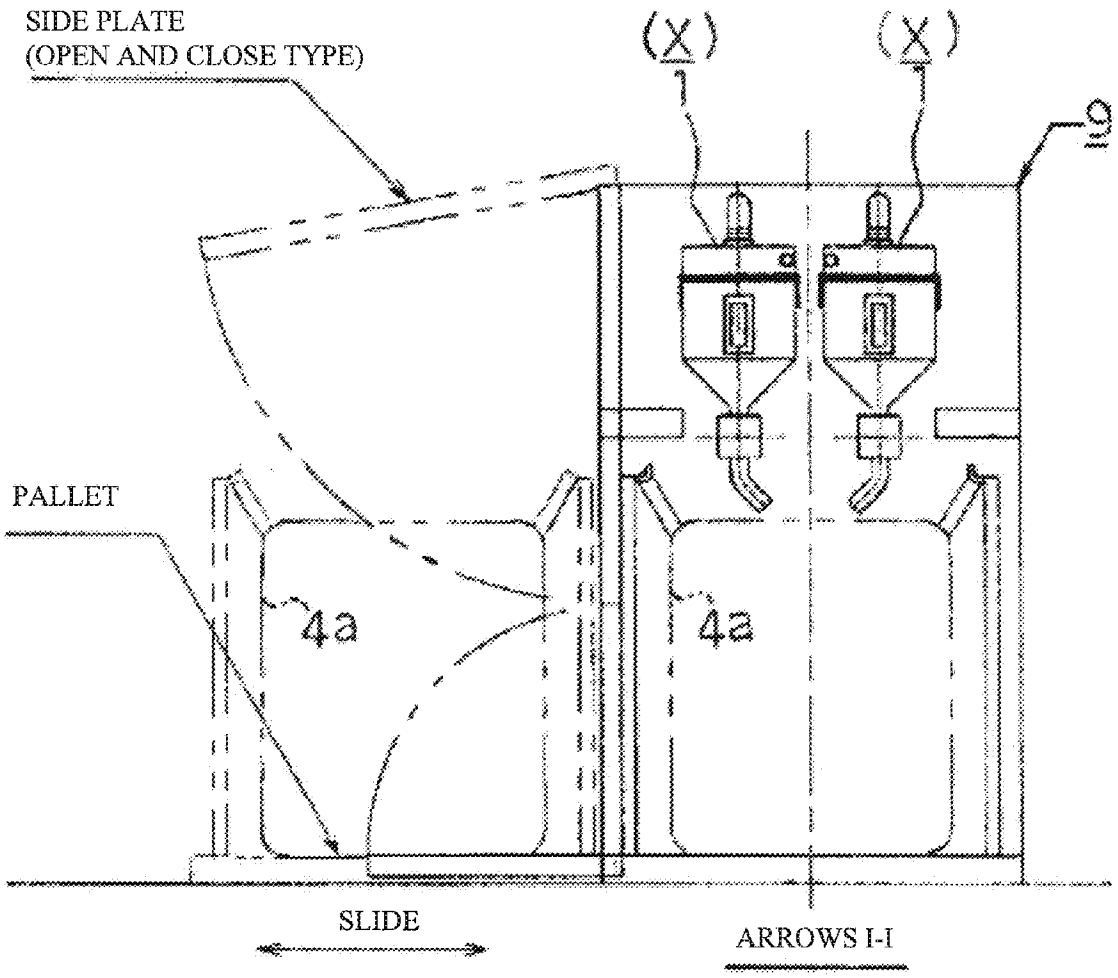
FIG. 9 is a configuration outline explanatory diagram taken along the line indicated by arrows 14 in FIG. 7.

FIG. 7 illustrates a configuration outline explanatory diagram in a front view, FIG. 8 illustrates a configuration outline explanatory diagram in a plan view, and FIG. 9 is a configuration outline explanatory diagram taken along the line indicated by arrows I-I in FIG. 7.

Figure 10:
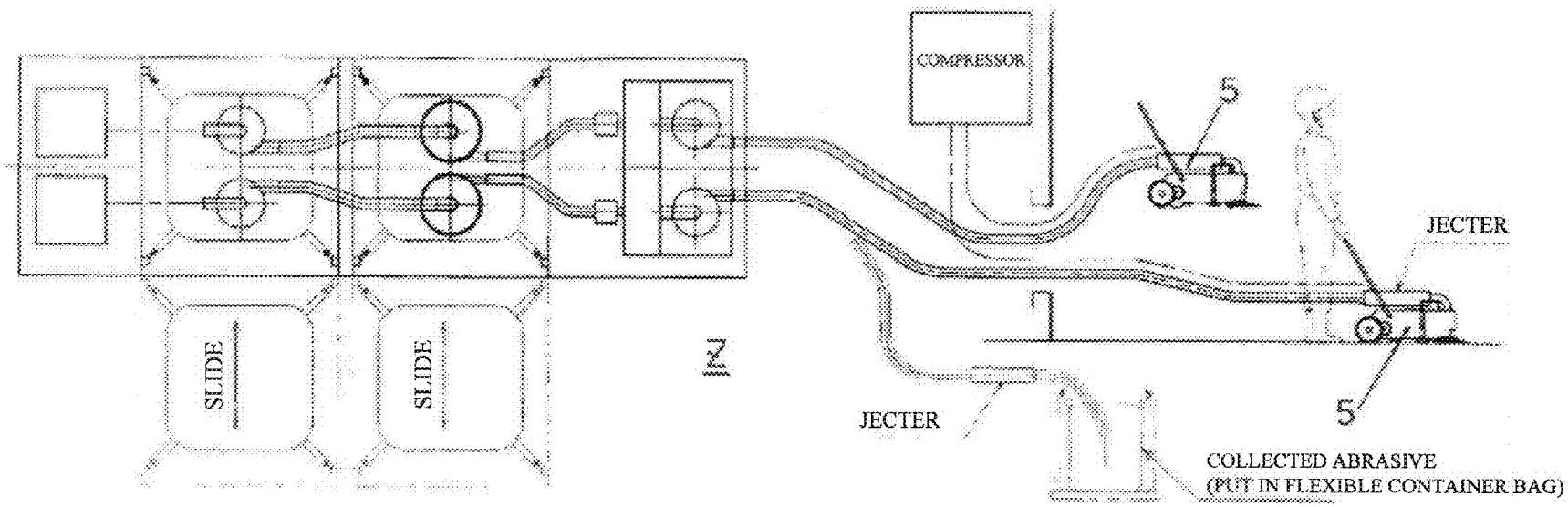
FIG. 10 is a configuration outline explanatory diagram of the embodiment system illustrating an example of connecting to an operation site.

In addition, FIG. 10 illustrates a configuration outline explanatory diagram of the embodiment system Z illustrating an example of connecting to an operation site.

Figure 11:
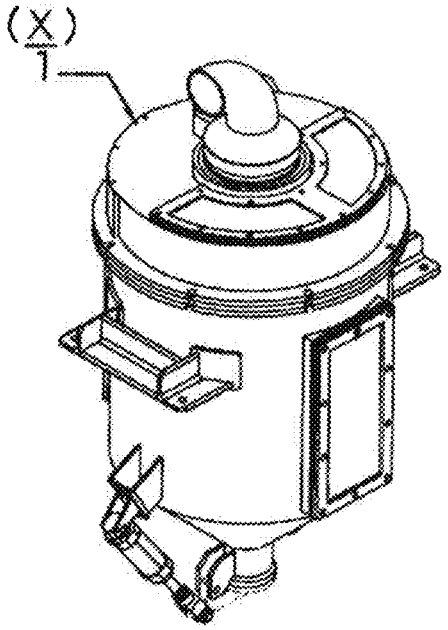
FIG. 11 is a perspective explanatory diagram of a powder and granular material separation processing device in a cross sectional view.

As illustrated in the figures, the embodiment system Z includes a powder and granular material separation processing device X (see FIG. 11 described later) that introduces by suction a mixture to be processed, in which powder and granular material made of an abrasive subjected to a blast process by a dry air blast device 5 (see FIG. 10) and accompanying lightweight foreign substances are mixed together, and separates the powder and granular material from industrial waste powder material by a dry method. The embodiment system Z houses upstream and downstream cooperation machines or cooperation devices (8-6-7) vacuum-connected to the powder and granular material separation processing device X inside a single frame serving as a platform and arranges them in line in the order of processes to perform the processes systematically.

A hopper tank device 8 is responsible for a first process to receive the mixture to be processed (one subjected to the blast process by the dry air blast device in the figures) from the outside of a system and temporarily store the same. In a case in which the mixture to be processed is supplied under pressure from the outside of the system, it is received while being degassed via a bag filter 81.

The powder and granular material separation processing device X (same as the embodiment device X described in the first embodiment) is responsible for a second process to separate recyclable granular material m1 with a relatively large grain diameter from industrial waste powder material m2 with a relatively small grain diameter by a dry method, the recyclable granular material m1 and the industrial waste powder material m2 being transferred and introduced from the hopper tank device 8 via a screw feeder 82 and constituting the mixture to be processed (the configuration of the device will be described in detail later). Under the device X, a detachable-and-replaceable flexible bag container 4*a* (hereinafter referred to as a flexible container bag) is installed in which the separated recyclable granular material is fallen and collected to be stored.

A cyclone dust collection device 6 is introduced from the powder and granular material separation processing device X via a tube and responsible for a third process to separate the separated industrial waste powder material from dust. Under the device 6, a detachable-and-replaceable flexible container bag 4*b* is installed in which the separated industrial waste powder material m2 is fallen and collected to be stored.

A suction device 7 such as an electric vacuum cleaner is connected to the cyclone dust collection device 6 via a tube and serves as a drive source for the vacuum path of the device system while being responsible for a fourth process to introduce by suction the separated dust and finally catch the same.

A portable device frame 9 is used to arrange a group of the devices (8-X-6-7) including the flexible container bags 4 in line in the order of the processes, house the same inside a single frame or casing, construct a device system unit having the process system of one line or a plurality of parallel lines, and is used as a platform capable of being transported and installed on site. The mode of the device system unit in the figures illustrates two parallel lines (FIG. 8 and FIG. 10).

Further, a compact processing system is constructed to put the device system unit into practice as a machine, and the first to fourth processes are systemized and executed inside the system.

Figure 12:
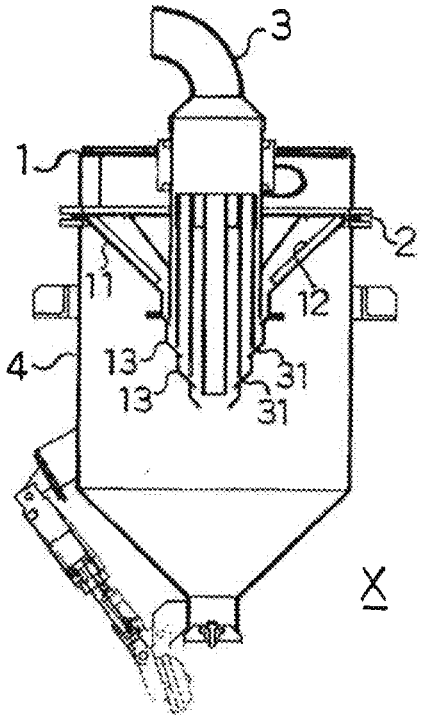
FIG. 12 is an explanatory diagram of a powder and granular material separation processing device in a cross-sectional view.

For the powder and granular material separation processing device X (same as the embodiment device X described in the first embodiment) responsible for the second process described above, FIG. 11 illustrates a perspective explanatory diagram and FIG. 12 illustrates an explanatory diagram in a cross-sectional view.

As illustrated in the figures, the powder and granular material separation processing device X includes a separation processing container 1 having a flexible container bag that collects and stores the recyclable granular material, a suction introduction tube 2 that is arranged as the upper part structure of the flexible container bag and receives the mixture to be processed on the circumferential surface thereof, and a suction discharge tube 3 that is connected to a cyclone dust collection device on the upper surface thereof.

Here, the specific structure of the separation processing container 1 has a separation cone 11 with a funnel-shaped bottom surface and a cylindrical opening 13 that hangs in a protruding shape downward from the tip part of the separation cone 11 and of which the opening diameter thereof is reduced stepwise to have multiple steps. The separation cone 11 has radially-formed rectification ribs 12 made of a plurality of elastic bodies on the inner front surface thereof.

In addition, the suction discharge tube 3 has a multiple tube configuration at the tip part thereof in which each axial core corresponds to the rotational axis (cone axis) of the separation cone 11 and each tube is given a small diameter corresponding to each opening diameter of the cylindrical opening 13 to be loosely inserted and face the tip part of the opening.

Further, the mixture to be processed, which is introduced by suction into the separation processing container 1, is fallen and guided to the cylindrical opening 13. Meanwhile, the industrial waste powder material is sucked by the suction discharge tube 3 through multiple stages and discharged to the downstream cyclone dust collection device, and the rest recyclable granular material is fallen and collected into the flexible container bag.

INDUSTRIAL APPLICABILITY

The present invention (the powder and granular material separation processing device and the powder and granular material separation processing method) according to the first basic application proposes an innovative method for increasing separation accuracy for a mixture to be processed in which powder and granular material and lightweight foreign substances small in their specific gravity difference are mixed together in that the powder and granular material separation processing device is cooperated with (connected to) an existing external suction machine to allow the lightweight foreign substances (industrial waste powder material) to be discharged through multiple stages and recyclable granular material to be collected inside a system with the control of the flow of the mixture to be processed in such a manner that its cascade falling and guiding and suction discharge are cooperated with each other inside a separation processing container.

The present invention (the powder and granular material separation and collection processing system) according to the second basic application configures a device system unit including respective machines (devices) responsible for processing an abrasive (mixture to be processed) subjected to the blast process of a blast operation, and has the machines mounted on a portable device frame capable of being transported and installed on site to systematically perform a series of processes from the separation to separated-collection of recyclable granular material and industrial waste powder material inside a device system, and is high in usefulness as a mobile and compact powder and granular material separation and collection processing system.

Any of the present inventions is useful in that workability is improved in separating and collecting an abrasive particularly subjected to a blast process by a dry air blast device as a mixture to be processed and that a cost reduction by material recycle is promoted, and can be expected to contribute to the field.

REFERENCE SIGNS LIST

1: separation processing container
11: separation cone
12: rectification rib
13: cylindrical opening
2: suction introduction tube
3: suction discharge tube
31: Multiple tube
4: hopper tank
41: collection container
5: dry air blast device
51: floor sweeper,
52: suction port (hose attachment)
6: dust collection device (cyclone dust collection device)
7: electric vacuum cleaner (suction device)
M: mixture to be processed
m1: recyclable granular material (reusable abrasive)
m2: industrial waste powder material (containing lightweight foreign substances and abrasive made into powder by depletion)
X: powder and granular material separation processing device, (embodiment device)
4*a*: flexible bag container (flexible container bag)
4*b*: flexible bag container (flexible container bag)
8: hopper tank device
81: bag filter
82: screw feeder
9: Portable device frame (platform)
Z: powder and granular material separation and collection processing system (embodiment system)

The invention claimed is:

1. A powder and granular material separation processing device that introduces a mixture to be processed, in which powder and granular material with relatively large specific gravity and hardness and initially formed into a grit or shot shape with a grain diameter of several mm or less and accompanying lightweight foreign substances are mixed together, into a system and separates the powder and granular material from the lightweight foreign substances by a dry method, wherein the powder and granular material separation processing device introduces by suction the mixture to be processed into a separation processing container connected to an external suction machine such as a dust collection device and an electric vacuum cleaner, separates the same using an airflow and a specific gravity difference with a control of a flow inside the container, and discharges the lightweight foreign substances to the external suction machine while collecting the powder and granular material inside the system, the powder and granular material separation processing device includes the separation processing container having a hopper tank that collects and stores the powder and granular material, a suction introduction tube that is attached and sealed as an upper part structure of the hopper tank and receives the mixture to be processed, and a suction discharge tube that is connected to the external suction machine on an upper surface thereof, the separation processing container has a separation cone with a funnel-shaped bottom surface and a cylindrical opening that hangs in a protruding shape downward from a portion of the separation cone and of which an opening diameter thereof is reduced stepwise to have multiple steps, the suction discharge tube has a multiple tube configuration at a portion thereof in which each axial core corresponds to a rotational axis (cone axis) of the separation cone and each tube is given a small diameter corresponding to each opening diameter of the cylindrical opening to be loosely inserted and face a portion of an opening, and the mixture to be processed introduced by suction into the separation processing container is fallen and guided to the cylindrical opening, while the lightweight foreign substances are sucked by the suction discharge tube through multiple stages and discharged to an outside of the system and the rest powder and granular material is freely fallen and collected inside the system.

2. The powder and granular material separation processing device according to claim 1, wherein the separation cone has radially-formed rectification ribs made of a plurality of elastic bodies on an inner front surface thereof.

3. A powder and granular material separation processing method for separating powder and granular material from lightweight foreign substances with a control of a flow in such a manner that falling and guiding of a mixture to be processed by the separation cone and suction discharge of the lightweight foreign substances by the suction discharge tube are cooperated with each other inside the separation processing container in the powder and granular material separation processing device according to claim 2, the method comprising the steps of:

receiving the mixture to be processed received by suction introduction on an inner front surface of the separation cone to be prevented from temporarily turning and falling while being separated by weight using an airflow generated inside the separation processing container; and sucking the lightweight foreign substances by the suction discharge tube through multiple stages and discharged to an outside of a system and the rest powder and granular material is fallen and collected when the mixture to be processed is fallen and guided to a cylindrical opening of the separation cone in a cascade state based on a subsequent free fall thereof with bouncing.

4. The powder and granular material separation processing method according to claim 3, further comprising the step of:

receiving, by the separation cone, the mixture to be processed with the radially-formed rectification ribs made of a plurality of elastic bodies on an inner front surface thereof to increase the falling and guiding of the mixture to be processed.

5. The powder and granular material separation processing device according to claim 1, wherein the mixture to be processed is one subjected to a blast process by a dry air blast device.

6. A powder and granular material separation processing method for separating powder and granular material from lightweight foreign substances with a control of a flow in such a manner that falling and guiding of a mixture to be processed by the separation cone and suction discharge of the lightweight foreign substances by the suction discharge tube are cooperated with each other inside the separation processing container in the powder and granular material separation processing device according to claim 5, the method comprising the steps of:

receiving the mixture to be processed received by suction introduction on an inner front surface of the separation cone to be prevented from temporarily turning and falling while being separated by weight using an airflow generated inside the separation processing container; and sucking the lightweight foreign substances by the suction discharge tube through multiple stages and discharged to an outside of a system and the rest powder and granular material is fallen and collected when the mixture to be processed is fallen and guided to a cylindrical opening of the separation cone in a cascade state based on a subsequent free fall thereof with bouncing.

7. The powder and granular material separation processing method according to claim 6, further comprising the step of:

receiving, by the separation cone, the mixture to be processed with radially-formed rectification ribs made of a plurality of elastic bodies on an inner front surface thereof to increase the falling and guiding of the mixture to be processed.

8. A powder and granular material separation processing method for separating powder and granular material from lightweight foreign substances with a control of a flow in such a manner that falling and guiding of a mixture to be processed by the separation cone and suction discharge of the lightweight foreign substances by the suction discharge tube are cooperated with each other inside the separation processing container in the powder and granular material separation processing device according to claim 1, the method comprising the steps of:

receiving the mixture to be processed received by suction introduction on an inner front surface of the separation cone to be prevented from temporarily turning and falling while being separated by weight using an airflow generated inside the separation processing container; and sucking the lightweight foreign substances by the suction discharge tube through multiple stages and discharged to an outside of a system and the rest powder and granular material is fallen and collected when the mixture to be processed is fallen and guided to a cylindrical opening of the separation cone in a cascade state based on a subsequent free fall thereof with bouncing.

9. The powder and granular material separation processing method according to claim 8, further comprising the step of:

receiving, by the separation cone, the mixture to be processed with radially-formed rectification ribs made of a plurality of elastic bodies on an inner front surface thereof to increase the falling and guiding of the mixture to be processed.

10. A powder and granular material separation processing device that is connected to an external suction machine such as a dust collection device and an electric vacuum cleaner, introduces by suction a mixture to be processed, in which powder and granular material made of an abrasive subjected to a blast process by a thy air blast device and accompanying lightweight foreign substances are mixed together, into a separation processing container, separates the same using an airflow and a specific gravity difference with a control of a flow inside the container, and discharges the lightweight foreign substances to an outside of a system toward the external suction machine while collecting the powder and granular material inside the system, wherein the separation processing container includes a hopper tank that collects and stores the powder and granular material, a suction introduction tube that is attached and sealed as an upper part structure of the hopper tank and receives the mixture to be processed, and a suction discharge tube that is connected to the external suction machine on an upper surface thereof, the separation processing container includes a separation cone with a funnel-shaped bottom surface and a cylindrical opening that hangs in a protruding shape downward from a portion of the separation cone and of which an opening diameter thereof is reduced stepwise to have multiple steps, the suction discharge tube has a multiple tube configuration at a portion thereof in which each axial core corresponds to a rotational axis (cone axis) of the separation cone and each tube is given a small diameter corresponding to each opening diameter of the cylindrical opening to be loosely inserted and face a portion of an opening, and the mixture to be processed introduced by suction into the separation processing container is fallen and guided to the cylindrical opening, while the lightweight foreign substances are sucked by the suction discharge tube through multiple stages and discharged to the outside of the system and the rest powder and granular material is freely fallen and collected inside the system.

11. The powder and granular material separation processing device according to claim 10, wherein the separation cone has radially-formed rectification ribs made of a plurality of elastic bodies on an inner front surface thereof.

12. A powder and granular material separation processing method for separating powder and granular material from lightweight foreign substances with a control of a flow in such a manner that falling and guiding of a mixture to be processed by the separation cone and suction discharge of the lightweight foreign substances by the suction discharge tube are cooperated with each other inside the separation processing container in the powder and granular material separation processing device according to claim 11, the method comprising the steps of:

receiving the mixture to be processed received by suction introduction on an inner front surface of the separation cone to be prevented from temporarily turning and falling while being separated by weight using an airflow generated inside the separation processing container; and sucking the lightweight foreign substances by the suction discharge tube through multiple stages and discharged to an outside of a system and the rest powder and granular material is fallen and collected when the mixture to be processed is fallen and guided to a cylindrical opening of the separation cone in a cascade state based on a subsequent free fall thereof with bouncing.

13. The powder and granular material separation processing method according to claim 12, further comprising the step of:

receiving, by the separation cone, the mixture to be processed with the radially-formed rectification ribs made of a plurality of elastic bodies on an inner front surface thereof to increase the falling and guiding of the mixture to be processed.

14. A powder and granular material separation processing method for separating powder and granular material from lightweight foreign substances with a control of a flow in such a manner that falling and guiding of a mixture to be processed by the separation cone and suction discharge of the lightweight foreign substances by the suction discharge tube are cooperated with each other inside the separation processing container in the powder and granular material separation processing device according to claim 10, the method comprising the steps of:

receiving the mixture to be processed received by suction introduction on an inner front surface of the separation cone to be prevented from temporarily turning and falling while being separated by weight using an airflow generated inside the separation processing container; and sucking the lightweight foreign substances by the suction discharge tube through multiple stages and discharged to an outside of a system and the rest powder and granular material is fallen and collected when the mixture to be processed is fallen and guided to a cylindrical opening of the separation cone in a cascade state based on a subsequent free fall thereof with bouncing.

15. The powder and granular material separation processing method according to claim 14, further comprising the step of:

receiving, by the separation cone, the mixture to be processed with radially-formed rectification ribs made of a plurality of elastic bodies on an inner front surface thereof to increase the falling and guiding of the mixture to be processed.

16. A powder and granular material separation processing method in which, in a powder and granular material separation processing device that is connected to an external suction machine such as a dust collection device and an electric vacuum cleaner and of which a separation processing container includes a hopper tank that collects and stores powder and granular material, a suction introduction tube that is attached and sealed as an upper part structure of the hopper tank and receives a mixture to be processed, and a suction discharge tube that is connected to the external suction machine on an upper surface thereof to introduce by suction the mixture to be processed, in which the powder and granular material made of an abrasive subjected to a blast process by a dry air blast device and accompanying lightweight foreign substances are mixed together, into the separation processing container, separate the same using an airflow and a specific gravity difference with a control of a flow inside the container, and discharge the lightweight foreign substances to an outside of a system toward the external suction machine while collecting the powder and granular material inside the system, the separation processing container includes a separation cone with a funnel-shaped bottom surface and a cylindrical opening that hangs in a protruding shape downward from a portion of the separation cone and of which an opening diameter thereof is reduced stepwise to have multiple steps, the suction discharge tube has a multiple tube configuration at a portion thereof in which each axial core corresponds to a rotational axis (cone axis) of the separation cone and each tube is given a small diameter corresponding to each opening diameter of the cylindrical opening to be loosely inserted and face a portion of an opening, and the powder and granular material is separated from the lightweight foreign substances with a control of a flow in such a manner that falling and guiding of the mixture to be processed by the separation cone and suction discharge of the lightweight foreign substances by the suction discharge tube are cooperated with each other inside the separation processing container, wherein the mixture to be processed received by suction introduction is received on an inner front surface of the separation cone to be prevented from temporarily turning and falling while being separated by weight using an airflow generated inside the separation processing container, and the lightweight foreign substances are sucked by the suction discharge tube through multiple stages and discharged to an outside of a system and the rest powder and granular material is fallen and collected when the mixture to be processed is fallen and guided to a cylindrical opening in a cascade state based on a subsequent free fall thereof with bouncing.

17. The powder and granular material separation processing method according to claim 16, further comprising the step of:

receiving, by the separation cone, the mixture to be processed with radially-formed rectification ribs made of a plurality of elastic bodies on an inner front surface thereof to increase the falling and guiding of the mixture to be processed.

18. A powder and granular material separation and collection processing system that includes a powder and granular material separation processing device that introduces by suction a mixture to be processed, in which powder and granular material with relatively large specific gravity and hardness and initially formed into a grit or shot shape with a grain diameter of several mm or less and accompanying lightweight foreign substances are mixed together, and separates the powder and granular material from the lightweight foreign substances by a dry method, houses upstream and downstream cooperation machines or cooperation devices vacuum-connected to the powder and granular material separation processing device inside a single frame serving as a platform, and arranges the same in line in an order of processes to perform the processes systematically, the powder and granular material separation and collection processing system comprising:

a hopper tank device that is responsible for a first process to receive the mixture to be processed from an outside of a system and temporarily store the same;

the powder and granular material separation processing device that is responsible for a second process to separate recyclable granular material with a relatively large grain diameter from industrial waste powder material and the lightweight foreign substances with a relatively small grain diameter by a dry method, the recyclable granular material, the industrial waste powder material, and the lightweight foreign substances being transferred and introduced from the hopper tank device and constituting the mixture to be processed;

a flexible bag container that is provided under the powder and granular material separation processing device so as to be detachable and replaceable and in which the separated recyclable granular material is fallen and collected to be stored;

a cyclone dust collection device that is introduced from the powder and granular material separation processing device via a tube and responsible for a third process to separate the separated industrial waste powder material and the lightweight foreign substances from dust;

a flexible bag container that is provided under the cyclone dust collection device so as to be detachable and replaceable and in which the separated industrial waste powder material and the lightweight foreign substances are fallen and collected to be stored;

a suction device such as an electric vacuum cleaner that is connected to the cyclone dust collection device via a tube and responsible for a fourth process to introduce by suction the separated dust and finally catch the same while serving as a drive source for a vacuum path of a device system; and a portable device frame that is used to arrange a group of the devices including the flexible bag containers in line in the order of the processes, house the same inside a single frame or casing, construct a device system unit having a processing system of one line or a plurality of parallel lines, and is used as a platform capable of being transferred and provided on site, wherein the device system unit is operated to execute the first to fourth processes systematically inside the system.

19. The powder and granular material separation and collection processing system according to claim 18, wherein the powder and granular material processing device includes a separation processing container having a hopper tank portion that collects and stores the powder and granular material, a suction introduction tube that is attached and sealed as an upper part structure of the hopper tank portion and receives the mixture to be processed, and a suction discharge tube that is connected to a suction machine on an upper surface thereof, the separation processing container has a separation cone with a funnel-shaped bottom surface and a cylindrical opening that hangs in a protruding shape downward from a portion of the separation cone and of which an opening diameter thereof is reduced stepwise to have multiple steps, the suction discharge tube has a multiple tube configuration at a portion thereof in which each axial core corresponds to a rotational axis (cone axis) of the separation cone and each tube is given a small diameter corresponding to each opening diameter of the cylindrical opening to be loosely inserted and face a portion of an opening, and the mixture to be processed introduced by suction into the separation processing container is fallen and guided to the cylindrical opening, while the lightweight foreign substances are sucked by the suction discharge tube through multiple stages and discharged to the downstream cyclone dust collection device and the rest powder and granular material is fallen and collected into the flexible bag container.

20. The powder and granular material separation and collection processing system according to claim 19, wherein the mixture to be processed is one subjected to a blast process by a dry air blast device and is supplied under pressure to the hopper tank device after being directly or temporarily stored.

21. The powder and granular material separation and collection processing system according to claim 18, wherein the mixture to be processed is one subjected to a blast process by a dry air blast device and is supplied under pressure to the hopper tank device after being directly or temporarily stored.

* * * * *